US011041618B2

(12) United States Patent
Kimpara

(10) Patent No.: US 11,041,618 B2
(45) Date of Patent: Jun. 22, 2021

(54) INFRARED RADIATION HEATER

(71) Applicant: SHIZUOKA SEIKI CO., LTD., Shizuoka (JP)

(72) Inventor: Naoya Kimpara, Shizuoka (JP)

(73) Assignee: SHIZUOKA SEIKI CO., LTD., Shizuoka-Ken (JP)

( * ) Notice: Subject to any disclaimer, the term of this patent is extended or adjusted under 35 U.S.C. 154(b) by 0 days.

(21) Appl. No.: 16/301,182

(22) PCT Filed: Dec. 27, 2016

(86) PCT No.: PCT/JP2016/088844
§ 371 (c)(1),
(2) Date: Nov. 13, 2018

(87) PCT Pub. No.: WO2018/122948
PCT Pub. Date: Jul. 5, 2018

(65) Prior Publication Data

US 2019/0309944 A1 Oct. 10, 2019

(51) Int. Cl.
*F23C 3/00* (2006.01)
*F23D 14/14* (2006.01)
(Continued)

(52) U.S. Cl.
CPC ..... *F23D 14/14* (2013.01); *F23C 3/002* (2013.01); *F24C 3/04* (2013.01); *F24C 7/02* (2013.01);
(Continued)

(58) Field of Classification Search
CPC .. F23D 14/14; F23C 3/002; F24C 3/04; F24C 7/02; F24C 15/02; H05B 3/10
(Continued)

(56) References Cited

U.S. PATENT DOCUMENTS 1,427,371 A 8/1922 Garbarini
3,245,458 A 4/1966 Patrick et al.
(Continued)

FOREIGN PATENT DOCUMENTS

EP 0035797 A1 9/1981
FR 2763670 A1 11/1998
(Continued)

OTHER PUBLICATIONS

Extended European Search Report dated Nov. 29, 2019 issued in corresponding European Patent Appln. No. 16925267.3.
(Continued)

*Primary Examiner* — Avinash A Savani
(74) *Attorney, Agent, or Firm* — Bacon & Thomas, PLLC

(57) ABSTRACT

An infrared radiation heater includes: a combustion chamber having a combustion space that is open on one side; a combustion device provided in the combustion chamber to combust air-fuel mixture made by mixing fuel with air; and a radiator configured to be heated by heat generated from the combustion device and including a radiation plane configured to emit infrared radiation. The combustion device includes: a nozzle provided in a flow path of the air to inject the fuel; a tubular body including a side surface that faces a direction with a predetermined angle with respect to the radiation plane, and a plurality of voids being formed on the side surface; and an ignition device provided outside of the tubular body and configured to ignite the air-fuel mixture. The air-fuel mixture flows into the tubular body, and the tubular body releases the air-fuel mixture from the voids into the combustion chamber.

6 Claims, 9 Drawing Sheets

(51) Int. Cl.

| | |
|---|---|
| ***F24C 3/04*** | (2006.01) |
| ***F24C 15/24*** | (2006.01) |
| ***F24D 15/02*** | (2006.01) |
| ***H05B 3/10*** | (2006.01) |
| ***F24C 7/02*** | (2006.01) |

(52) U.S. Cl.
CPC ..... *F24C 15/24* (2013.01); *F24D 15/02* (2013.01); *H05B 3/10* (2013.01)

(58) Field of Classification Search
USPC ..... 126/92 AC, 92 B
See application file for complete search history.

(56) References Cited

U.S. PATENT DOCUMENTS 3,269,449 A 8/1966 Witten, Jr.
3,330,267 A 7/1967 Bauer
3,349,752 A * 10/1967 Murphy ..... A01K 31/19 119/307
3,726,633 A 4/1973 Vasilakis et al.
3,975,140 A 8/1976 Placek
4,140,100 A * 2/1979 Ishihara ..... F23C 3/002 126/92 B
5,017,129 A * 5/1991 Velie ..... F23D 14/58 126/92 AC
5,417,389 A * 5/1995 Chew ..... B64F 5/27 126/92 AC
5,645,043 A * 7/1997 Long ..... F24C 1/10 126/92 AC
2004/0152028 A1* 8/2004 Singh ..... F23D 14/14 431/328
2009/0241943 A1* 10/2009 Schwank ..... F24C 3/08 126/91 A
2011/0094504 A1* 4/2011 Kim ..... F23D 14/70 126/92 AC

FOREIGN PATENT DOCUMENTS

GB 1017760 A 1/1966
JP S58_182020 S 10/1983
JP S58182020 A 10/1983
JP 62_297615 A 12/1987
JP 2-230027 A 12/1990
JP 3_233230 A 10/1991
JP 1_036004 B 7/1998
JP 2004_270956 A 9/2004
JP 2004-270956 A 9/2004
JP 2010_133568 A 6/2010

OTHER PUBLICATIONS

First Office Action issued in corresponding European Application No. 16925267.3 dated Nov. 11, 2020.
English Translation of International Search Report, dated Mar. 7, 2017.
Japanese First Office Action (Notice of Reasons for Refusal with translation) cited in Japanese Patent Application No. 2018-558554.
Japanese Second Office Action dated Mar. 16, 2021 (Notice of Reasons for Refusal with translation) issued in corresponding Japanese Patent Application No. 2018-558554.

* cited by examiner

INFRARED RADIATION HEATER

TECHNICAL FIELD

The present invention relates to an infrared radiation heater.

BACKGROUND ART

There has been known an infrared radiation heater including a burner as a combustion device for combusting air-fuel mixture made by mixing fuel with air in the combustion chamber, and a radiator for emitting infrared radiation provided in either of the combustion chambers (see, for example, Patent Literature 1).

The infrared radiation heater disclosed in Patent Literature 1 emits infrared radiation by burning the air-fuel mixture from the burner in the combustion chamber to shoot flames at the radiator so that the radiator turns red. The burner used here is a gun type burner configured to shoot flames at the radiator in front of the burner.

CITATION LIST

Patent Literature

PTL1: Japanese Patent Application Laid-Open No. 2004-270956

SUMMARY OF INVENTION

Technical Problem

Conventional infrared radiation heaters, such as the infrared radiation heater disclosed in Patent Literature 1 cannot evenly heat the whole radiator because the burner is configured to shoot flames at the radiator in front of the burner, and therefore it is not possible to improve the infrared radiation efficiency. In addition, a conventional infrared radiation heater has a problem of so-called "backfire" where the flames produced by the burner returns to the burner to burn the fuel, which causes a malfunction.

It is therefore an object of the present invention to provide an infrared radiation heater capable of improving the infrared radiation efficiency while preventing a malfunction due to the flame produced by a combustion device.

Solution to Problem

An aspect of the present invention provides an infrared radiation heater including: a combustion chamber having a combustion space that is open on one side; a combustion device provided in the combustion chamber and configured to combust air-fuel mixture made by mixing fuel with air; and a radiator configured to be heated by heat generated from the combustion device and including a radiation plane configured to emit infrared radiation. The combustion device includes: a nozzle provided in a flow path of the air, and configured to inject the fuel; a tubular body including a side surface that faces a direction with a predetermined angle with respect to the radiation plane, and a plurality of voids being formed on the side surface; and an ignition device provided outside of the tubular body and configured to ignite the air-fuel mixture. The air-fuel mixture flows into the tubular body from a first end of the tubular body in the nozzle side, and the tubular body releases the air-fuel mixture from the voids into the combustion chamber.

In the infrared radiation heater, the voids may be formed on a side surface of the tubular body in a circumferential direction.

In the infrared radiation heater, the voids may be formed in a mesh pattern.

In the infrared radiation heater, the combustion device may include a heat insulator provided at a second end of the tubular body, and configured to insulate between the tubular body and the radiator, and the radiator may be located to face the heat insulator.

In the infrared radiation heater, an impeller may be provided in the flow path of the air to generate a swirl flow in the air-fuel mixture flowing through the tubular body.

In the infrared radiation heater, the impeller may be a fixed type impeller made of a plate material.

According to the present invention, it is possible to improve the infrared radiation efficiency of the infrared radiation heater while preventing a malfunction due to the flame projected from the combustion device.

DESCRIPTION OF EMBODIMENTS

Hereinafter, an embodiment of the present invention will be described with reference to the drawings.

<Configuration of Infrared Radiation Heater>

Figure 1:
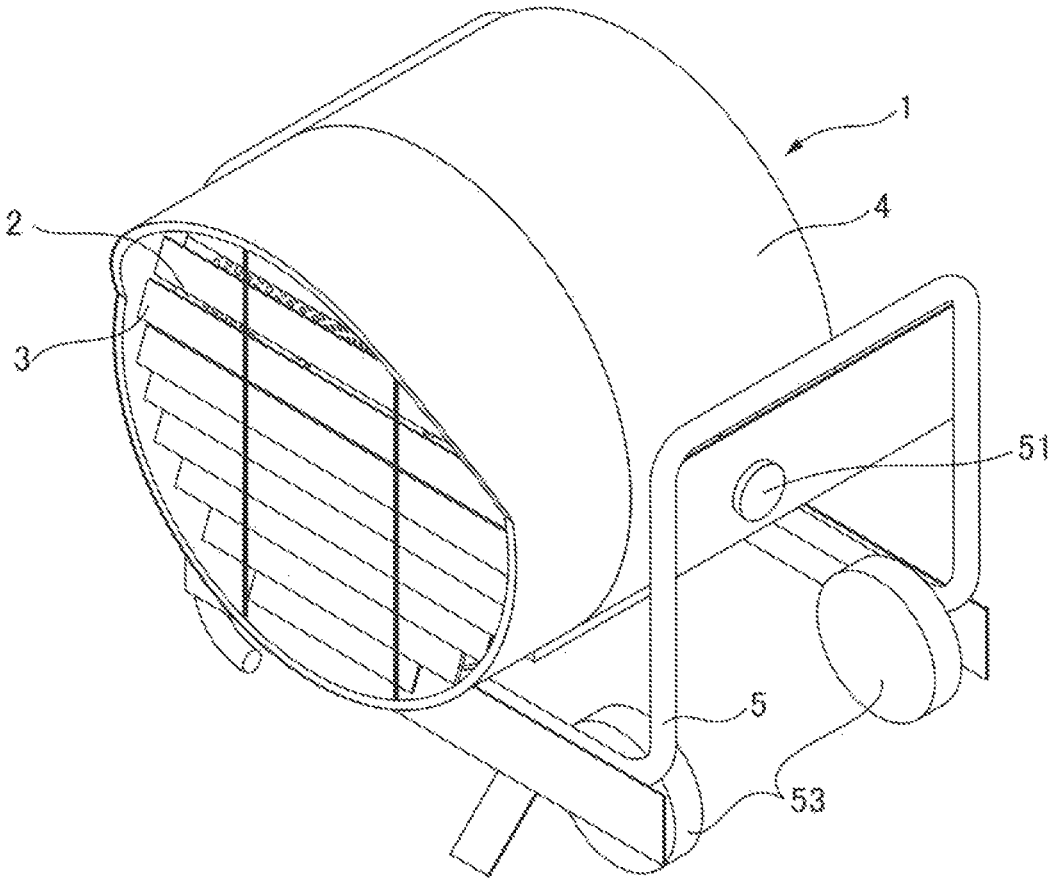
FIG. 1 is a schematic view illustrating an infrared radiation heater according to an embodiment of the present invention.

FIG. 1 is a schematic view illustrating an infrared radiation heater 1 according to an embodiment of the present invention. As illustrated in FIG. 1, the infrared radiation heater 1 includes a radiator 2 configured to emit radiant heat; a louver 3 configured to control the direction of the radiant heat or warm air from the radiator 2; a casing 4 configured to accommodate a combustion chamber 21 and a combustion device 6 described later; and a frame 5 configured to support the casing 4. Here, the infrared radiation heater 1, the combustion chamber 21, and the combustion device 6 correspond to "infrared radiation heater", "combustion chamber", and "combustion device" recited in the claims, respectively.

The frame 5 includes a side support 51 configured to support each side surface of the casing 4, and a pair of wheels 53 provided on the bottom of the frame 5 to help carry the infrared radiation heater 1.

Figure 2:
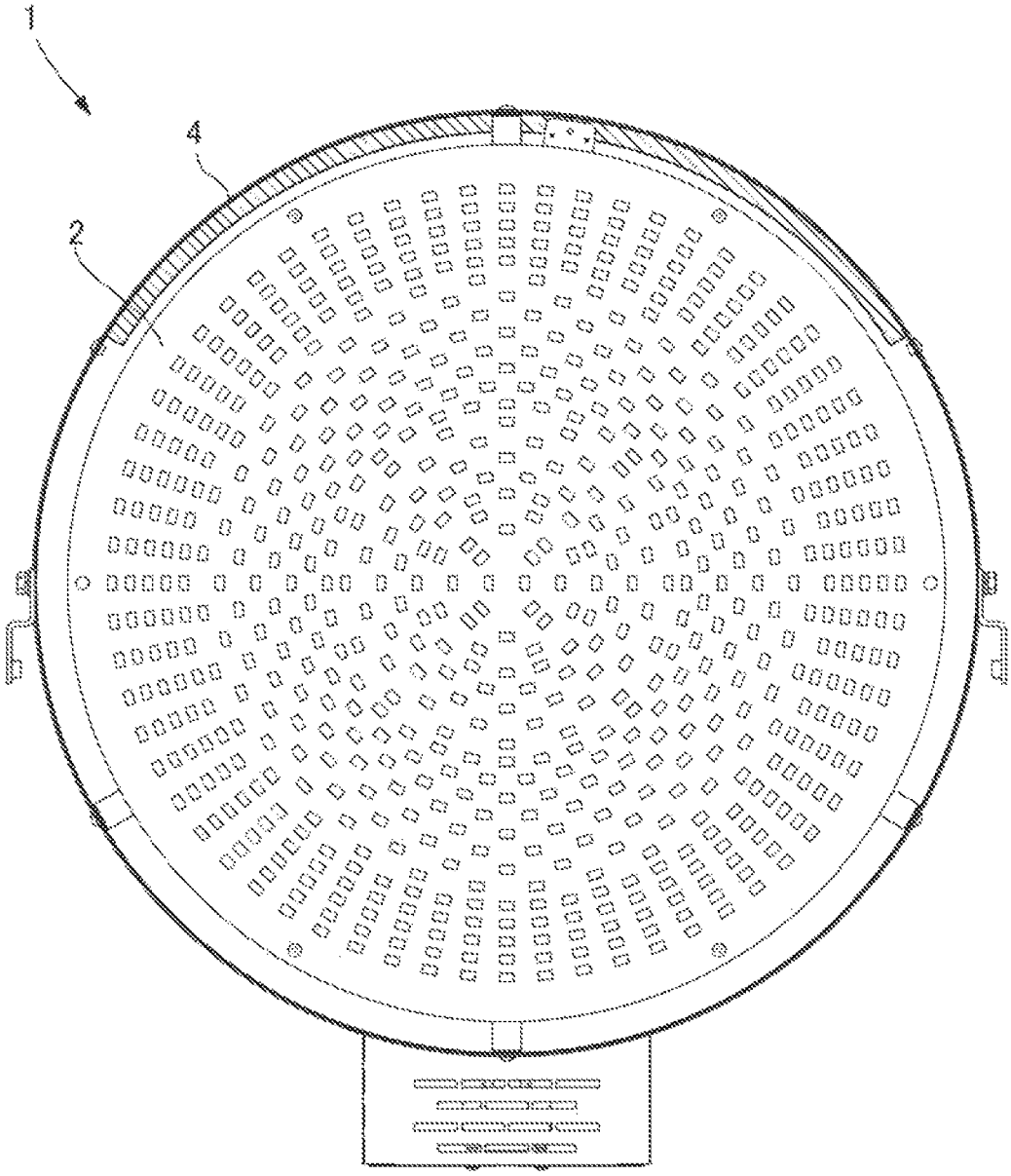
FIG. 2 is a front view illustrating the infrared radiation heater illustrated in FIG. 1.
Figure 3:
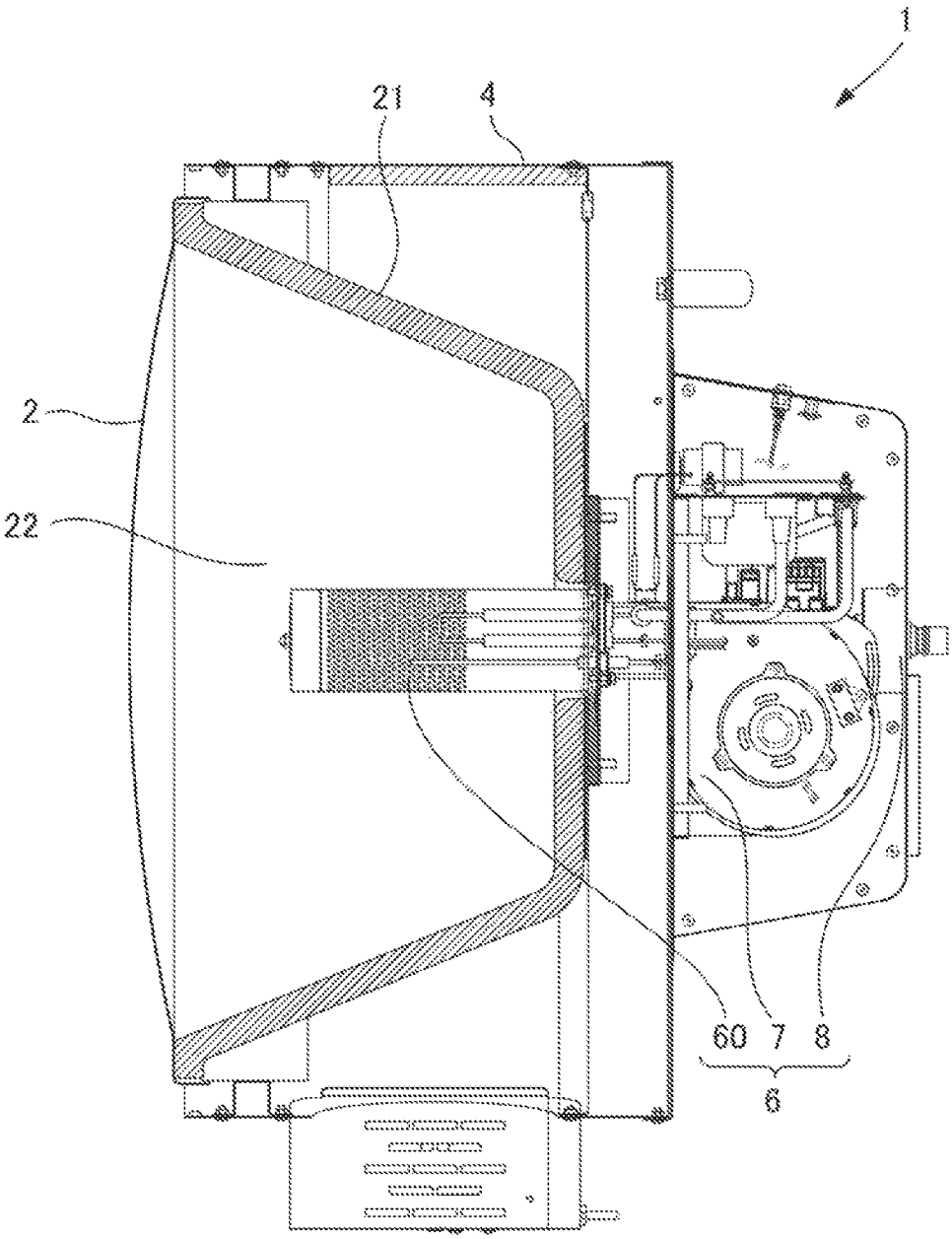
FIG. 3 is a side cross-sectional view illustrating the infrared radiation heater illustrated in FIG. 1.

FIG. 2 is a front view illustrating the infrared radiation heater 1 illustrated in FIG. 1. FIG. 3 is a side cross-sectional view illustrating the infrared radiation heater 1. As illustrated in FIGS. 2 and 3, the infrared radiation heater 1 includes the combustion chamber 21 provided in the casing 4, and the combustion device 6 configured to combust fuel in the center of a combustion space 22 in the combustion chamber 21.

The combustion chamber 21 is made of a material with high heat insulating properties, for example, a heat insulating material. The combustion chamber 21 includes a bottom, and an opening on the opposite side of the bottom. The combustion chamber 21 includes the combustion space 22 as space in which the combustion device 6 combusts fuel. With the present embodiment, the combustion chamber 21 has a truncated cone shape where the side surface inclines from the approximately circular bottom to the opening. Here, with the present embodiment, the shape of the combustion chamber 21 of the infrared radiation heater 1 is not limited to the truncated cone as long as the combustion chamber includes the bottom, the side surface and the opening.

The radiator 2 is provided on (or in) the opening of the combustion chamber 21. The radiator 2 is a dome-like member as a convex in the direction in which the infrared radiation is emitted, opposite to the combustion device 6. The radiator 2 is made of a material with a high emissivity of infrared radiation, for example, heat-resistant stainless steel. The radiator 2 has a radiation plane to emit heat. The radiation plane of the radiator 2 is shaped to fit the opening of the combustion chamber 21. The radiator 2 turns red by the heat of the flame generated by the combustion device 6, so that infrared radiation is emitted from the radiation plane to the outside. Here, for the infrared radiation heater 1 according to the present embodiment, the shape of the radiation plane is not limited to the dome shape.

<Configuration of Combustion Device>

Figure 4:
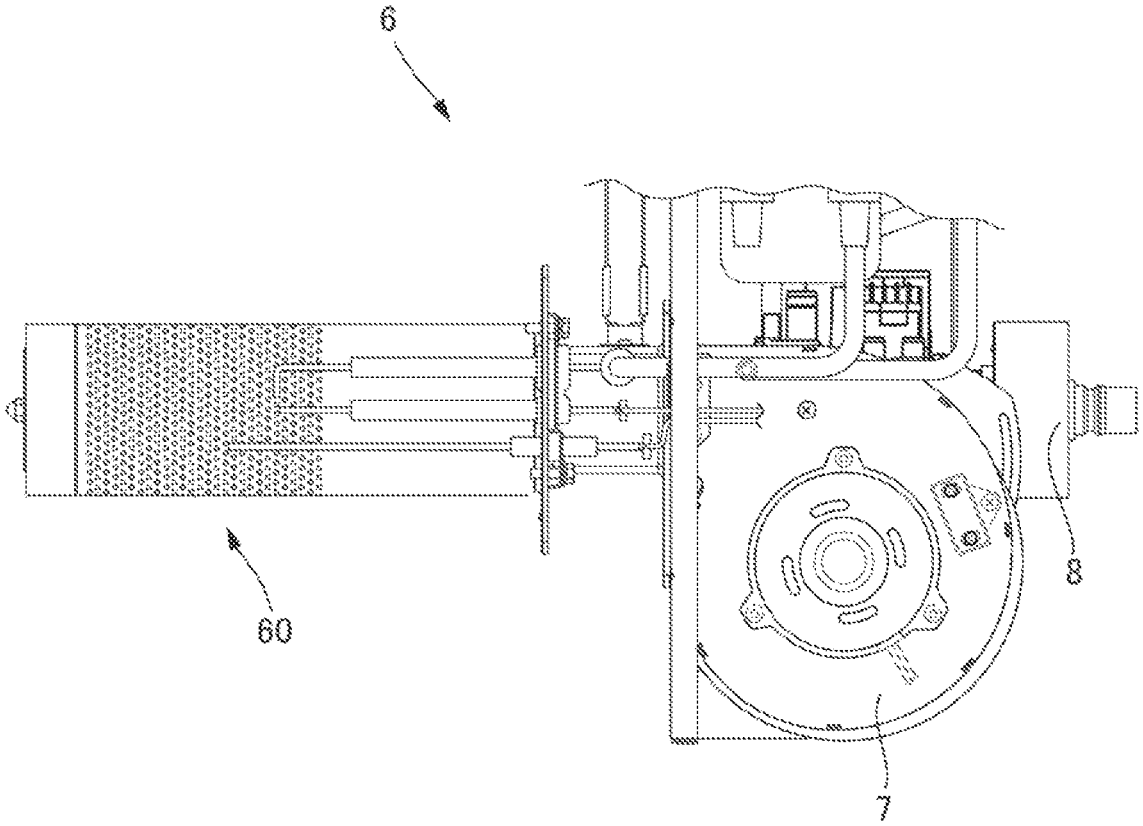
FIG. 4 is a side view illustrating a combustion device of the infrared radiation heater illustrated in FIG. 1.

Next, the configuration of the combustion device 6 of the infrared radiation heater 1 will be described. FIG. 4 is a side view illustrating the combustion device 6 of the infrared radiation heater 1. As illustrated in FIG. 4, the combustion device 6 includes a burner head 60, a fan 7, a gas pipe connector 8.

The burner head 60 combusts air-fuel mixture made by mixing propane gas introduced from the gas pipe connector 8 with the air supplied from the fan 7 in the combustion space 22 located outside the burner head 60.

An air outlet of the fan 7 is connected to one end of the burner head 60 to supply the air required to combust the fuel in the combustion device 6.

Figure 5:
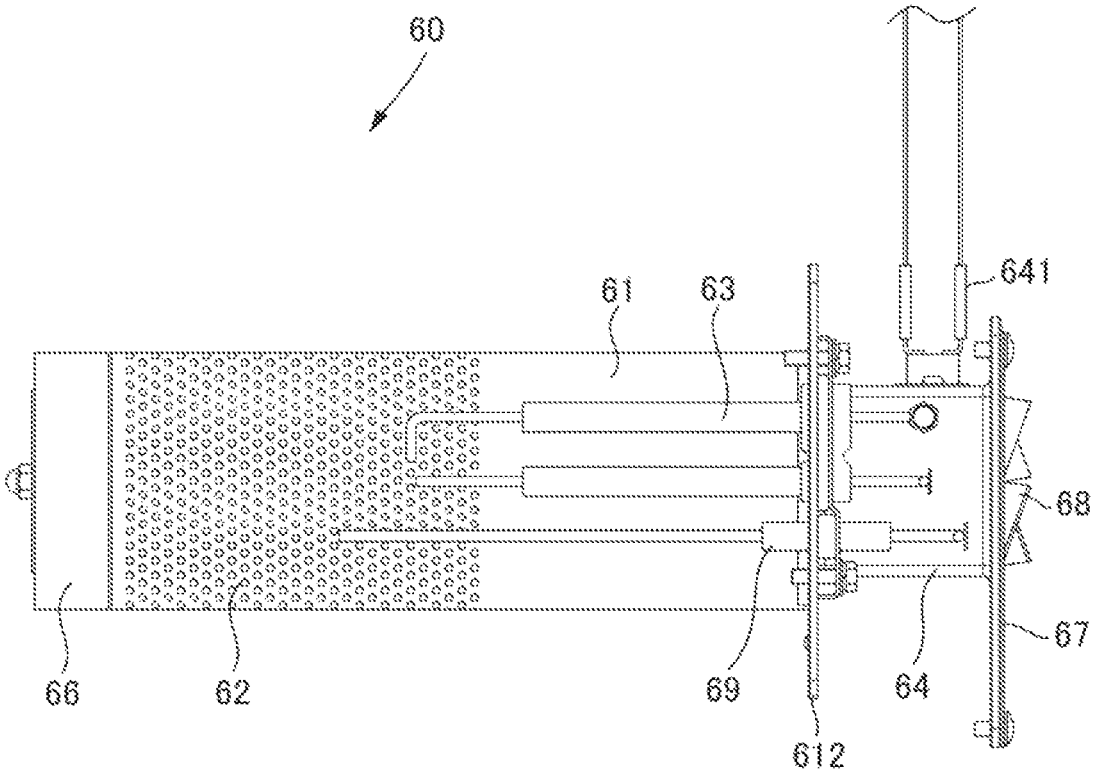
FIG. 5 is a side view illustrating a burner head of the combustion device illustrated in FIG. 4.
Figure 6:
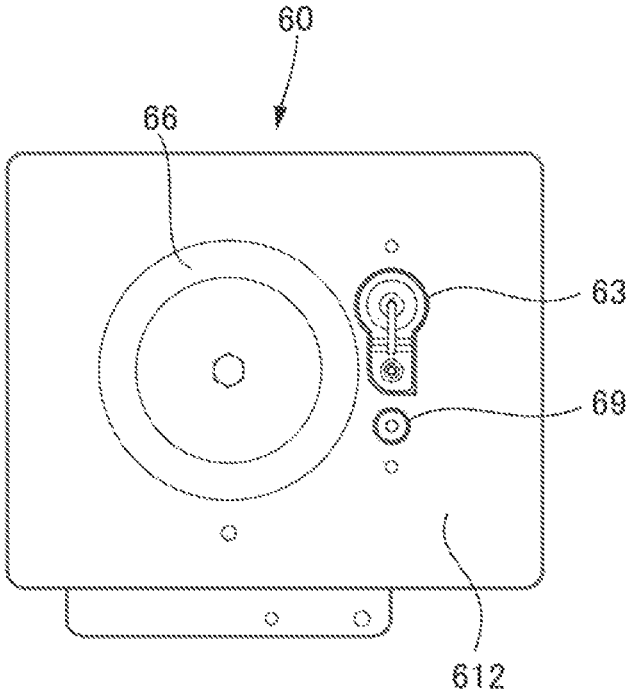
FIG. 6 is a front view illustrating the burner head illustrated in FIG. 5.
Figure 7:
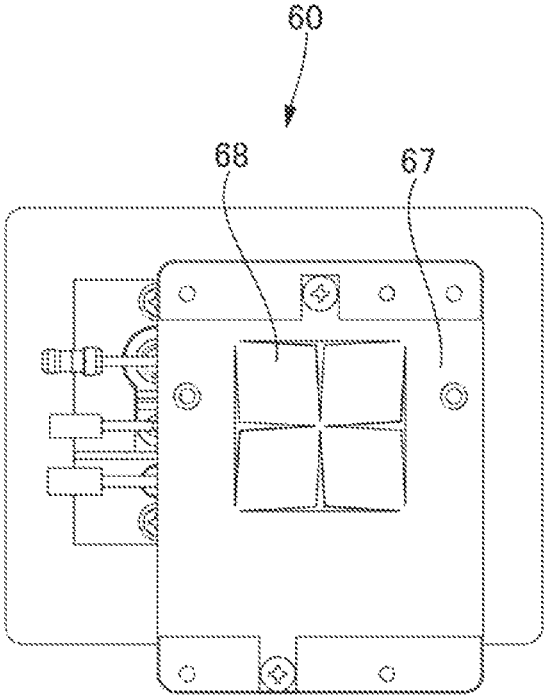
FIG. 7 is a rear view illustrating the burner head illustrated in FIG. 5.
Figure 8:
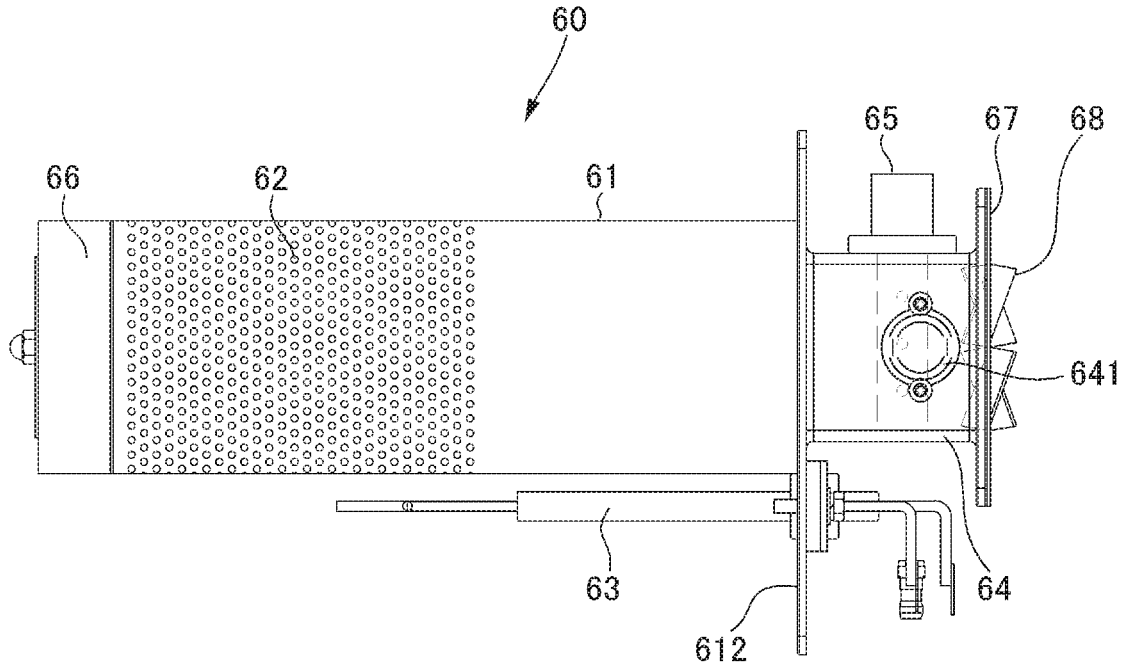
FIG. 8 is a plan view illustrating the burner head illustrated in FIG. 5.

FIG. 5 is a side view illustrating the burner head 60 of the combustion device 6. FIG. 6 is a front view illustrating the burner head 60, FIG. 7 is a rear view illustrating the burner head 60, and FIG. 8 is a plan view illustrating the burner head 60.

As illustrated in FIGS. 5 to 8, the burner head 60 includes a tubular body 61, voids 62, an ignition device 63, a mixer 64, a nozzle 65, a heat insulator 66, a swirl flow generator 67, an impeller 68, and a flame rod 69.

The tubular body 61 is made of, for example, heat-resistant metal. The tubular body 61 having a pillar shape is constituted by basal planes which are a base 612 provided at one end (first end) in the nozzle 65 side and the heat insulator 66 at the other end (second end) opposite to the nozzle 65 side; and a side surface connecting to the basal planes. The interior of the tubular body 61 forms space enclosed by the basal planes and the side surface. The basal planes of the tubular body 61 are approximately parallel to the radiation plane of the radiator 2. The side surface of the tubular body 61 is approximately perpendicular to the radiation plane of the radiator 2. Here, the side surface of the tubular body 61 is not necessarily be approximately perpendicular to the radiation plane of the radiator 2 as long as the side surface of the tubular body 61 has a predetermined angle with respect to the radiation plane so as to be able to spread the flame on the radiation plane of the radiator 2.

The voids 62 are formed on the side surface of the tubular body 61. As illustrated in FIG. 5, the voids 62 are microscopic round holes evenly formed in a range from the center of the side surface of the tubular body 61 to the second end of the tubular body 61 near the heat insulator 66. The shape of the voids 62 may not be limited to circle as illustrated in FIG. 5, but may be, for example, square, or a slit-like pore. In addition, the size of the voids 62, and the interval between the voids 62 may not be even. Moreover, the voids 62 may not be necessarily perforated on the side surface of the tubular body 61 made of a metal plate as illustrated in FIG. 5, but may be realized by forming the side surface of the tubular body 61 by a material having microscopic apertures such as metal knit or a sintered article.

The ignition device 63 is provided outside the tubular body 61, for example, along the side surface of the tubular body 61. For example, the ignition device 63 is provided on the base 612 located in the first end side of the tubular body 61. The ignition device 63 is, for example, an ignition plug with an electrode to generate an electric spark.

The mixer 64 is a hollow pillar body connecting the tubular body 61 to the fan 7 to allow communication between the tubular body 61 and the fan 7. The mixer 64 allows the air from the fun 7 to flow into the space of the tubular body 61. As illustrated in FIG. 8, the mixer 64 is provided with the nozzle 65. In addition, as illustrated in FIG. 5, the mixer 64 is provided with an overheat protector 641 to detect a flame when the fuel in the tubular body 61 or the mixer 64 ignites and catches fire.

The nozzle 65 is provided in the mixer 64. The nozzle 65 is inserted into the mixer 64 from the side surface of the mixer 64. Holes are formed in the nozzle 65 to inject the fuel into the mixer 64. With the present embodiment, propane gas is used as the fuel as described above, and therefore the shape of the nozzle 65 is suitable to inject the propane gas. When another type of fuel, for example, kerosene is used, it is preferred that the shape of the nozzle 65 is suitable to inject the kerosene.

The heat insulator 66 is provided on the basal plane of the tubular body 61 in the second end side. As illustrated in FIG. 3, the heat insulator 66 is provided in the combustion space 22 to face the inner surface of the radiator 2. The heat insulator 66 is made of a material with high heat insulating properties, for example, rock wool, alumina fibers or a ceramic. The heat insulator 66 insulates between the tubular body 61 and the radiator 2 to prevent the heat from the radiator 2 from transferring to the tubular body 61.

The swirl flow generator 67 is made of, for example, a metal plate material. For example, the swirl flow generator 67 is provided on the mixer 64 near the fan 7, to be more specific, provided in an airflow path closer to the fan 7 than the nozzle 65. The swirl flow generator 67 has the impeller 68 provided in the airflow path to generate a swirl flow in the air-fuel mixture flowing through the tubular body 61.

As illustrated in FIG. 7, the swirl flow generator 67 as a plate is cut into an approximate rectangle, leaving uncut four corners, and each side of the rectangle separated from the swirl flow generator 67 is cut at an approximate middle point to form four approximate rectangular blades. Then, the separated portions are turned to form the impeller 68. Here, in the swirl flow generator 67, the corners of the four rectangular blades at the center of the impeller 68 are not separated from each other. The air flows through the gap created between each of the four corners of the impeller 68 which are not separated from the swirl flow generator 67 and the center of the swirl flow generator 67 where the four rectangular blades are not separated from each other.

The number of blades, the shape of the impeller 68, and the shape of the airflow path may not be limited to the present embodiment as long as the swirl flow generator 67 and the impeller 68 can generate a swirl flow in the air-fuel mixture flowing through the tubular body 61. In addition, the impeller 68 is not limited to the fixed type impeller made of a plate material as described in the present embodiment, but may be, for example, rotor blades rotating about a rotating shaft. Moreover, the impeller 68 is not necessarily located between the fan 7 and the nozzle 65 in the airflow path as the present embodiment. For example, the impeller 68 may be disposed in the airflow path behind the nozzle 65.

The flame rod 69 is provided outside the tubular body 61, for example, along the side surface of the tubular body 61. For example, the flame rod 69 is provided on the base 612 to which the first end of the tubular body 61 is attached. The flame rod 69 is made of a steel material with heat resistance. The flame rod 69 detects the presence or absence of a flame, based on a change in current flowing through the steel material.

Figure 9:
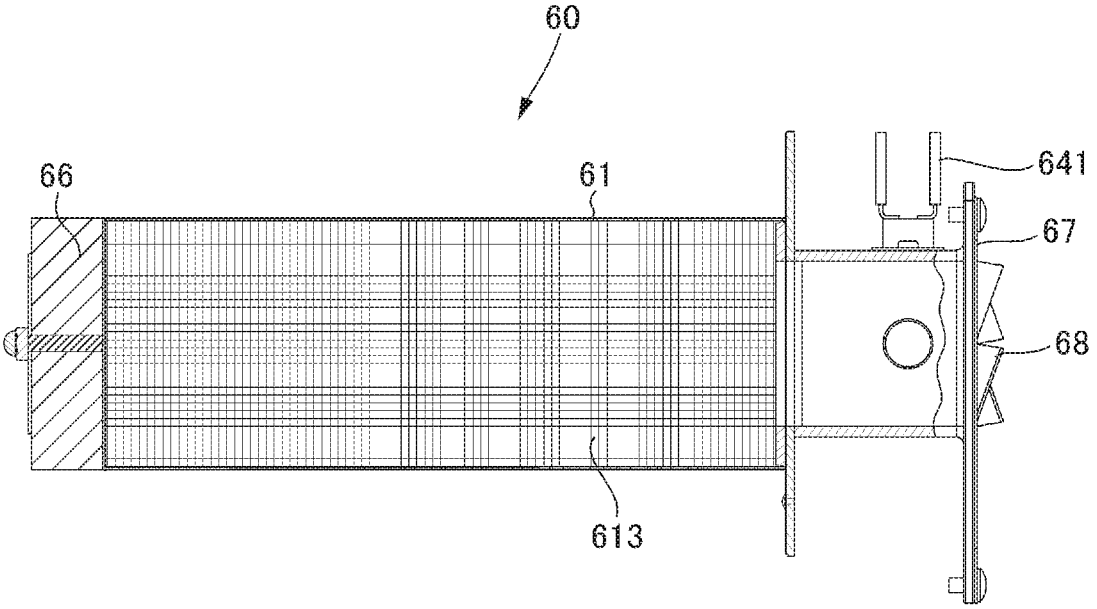
FIG. 9 is a side cross-sectional view illustrating the burner head illustrated in FIG. 5.

FIG. 9 is a side cross-sectional view illustrating the burner head 60. As illustrated in FIG. 9, mesh 613 is provided in the tubular body 61 of the burner head 60 along the inner wall of the tubular body 61. For example, the mesh 613 is metal mesh with heat resistance, and is configured to prevent a flame from entering the tubular body 61 from the voids 62. In addition, the mesh 613 can prevent exterior dirt from entering the combustion device 6. Moreover, the mesh 613 can control an appropriate amount of air-fuel mixture exiting the tubular body 61 from the voids 62.

<Operation of Infrared Radiation Heater>

Next, the operation of the infrared radiation heater 1 will be described. In the infrared radiation heater 1, the gas supplied from the gas pipe connector 8 is jetted from the nozzle 65, and air is supplied from the fan 7 to the mixer 64. A swirl flow is formed in the air supplied from the fan 7 by the impeller 68 of the swirl flow generator 67 to mix the air with the gas from the nozzle 65 well, so that air-fuel mixture is generated. Therefore, the infrared radiation heater 1 can restrain the unevenness of the flame, so that it is possible to restrain the unevenness of the heat transferring to the radiator 2.

The air-fuel mixture made in the mixer 64 flows into the tubular body 61 from the first end of the tubular body 61. The air-fuel mixture supplied into the tubular body 61 is spread in a predetermined direction along the radiation plane of the radiator 2, via the plurality of microscopic voids 62 formed on the side surface of the tubular body 61, and then is released to the outside of the tubular body 61, that is, released into the combustion space 22 of the combustion chamber 21.

The air-fuel mixture released into the combustion space 22 is ignited by a spark generated by the ignition device 63 provided outside the tubular body 61. Ignited air-fuel mixture spreads and burns in a direction with a predetermined angle, for example, a direction along the radiation plane of the radiator 2 to form a flame.

The mesh 613 provided in the tubular body 61 and the voids 62 prevent the flame from entering the tubular body 61. Therefore, the infrared radiation heater 1 can prevent the gas from burning in the tubular body 61 with the flame entering the tubular body 61, that is, prevent so-called "backfire."

The whole radiator 2 is evenly heated by the flame spreading in the direction along the radiation plane of the radiator 2 and turns red. Infrared radiation is emitted from the whole radiation plane of the radiator 2 to the outside.

Effect of Embodiment

In the infrared radiation heater 1 according to the present embodiment, the air-fuel mixture enters the tubular body 61 from the first end of the tubular body 61 located in the nozzle 65 side. In the infrared radiation heater 1, the side surface of the tubular body 61 faces the direction with a predetermined angle with respect to the radiation plane of the radiator 2. In addition, in the infrared radiation heater 1, the air-fuel mixture is released into the combustion chamber 21 from the plurality of microscopic voids 62 formed on the side surface of the tubular body 61. Therefore, the infrared radiation heater 1 can generate a flame in the direction along the radiation plane of the radiator 2. Consequently, it is possible to evenly heat the whole radiation plane of the radiator 2 to improve the infrared radiation efficiency. In addition, the infrared radiation heater 1 can prevent the flame from returning to the inside of the tubular body 61 by the plurality of microscopic voids 62.

The infrared radiation heater 1 includes the heat insulator 66 disposed in the second end of the tubular body 61 of the combustion device 6 to insulate between the tubular body 61 and the radiator 2. Therefore, the infrared radiation heater 1 can prevent the heat emitted from the radiator 2 from transferring to the tubular body 61, and consequently it is possible to prevent the air-fuel mixture in the tubular body 61 from being heated, and therefore prevent the backfire. In addition, the infrared radiation heater 1 includes the heat insulator 66, and therefore it is possible to prevent deterioration of the front end of the tubular body 61 due to the heat from the radiator 2.

In the infrared radiation heater 1, the impeller 68 is provided in the airflow to generate a swirl flow in the air-fuel mixture flowing through the tubular body 61. By this means, the infrared radiation heater 1 can mix the gas with the air well to make the air-fuel mixture, and therefore it is possible to improve the combustion state of the gas.

The infrared radiation heater 1 includes the fixed type impeller 68 made of a plate material, and therefore it is possible to improve the combustion state of the gas without any movable part.

The infrared radiation heater 1 includes the voids 62 formed on a side surface of the tubular body 61 in the circumferential direction, and therefore it is possible to generate a flame in the direction along the radiation plane of the radiator 2, and consequently to evenly heat the whole radiation plane of the radiator 2.

The infrared radiation heater 1 includes the mesh 613 formed in the tubular body 61, which is provided for the voids 62. Consequently, it is possible to prevent the flame from returning to the inside of the tubular body 61. Moreover, the mesh 613 can prevent exterior dirt from entering the combustion device 6 which causes a malfunction of the infrared radiation heater 1.

The infrared radiation heater 1 according to the present embodiment is applicable to a heater configured to combust fuel other than the above-described propane gas and kerosene, for example, natural gas.

REFERENCE SIGNS LIST

1 infrared radiation heater
2 radiator
3 louver
4 casing
5 frame
6 combustion device
7 fan
8 gas pipe connector
21 combustion chamber
22 combustion space
51 side surface support
53 wheel
60 burner head
61 tubular body
62 void
63 ignition device
64 mixer
65 nozzle
66 heat insulator
67 swirl flow generator
68 impeller
69 flame rod
612 base
613 mesh
641 overheat protector

The invention claimed is:

1. An infrared radiation heater comprising:

a combustion chamber having a combustion space, a bottom, and an opening on a side opposite the bottom;

a combustion device provided in the combustion chamber and configured to combust air-fuel mixture made by mixing fuel with air; and a radiator provided in the opening of the combustion chamber and configured to be heated by heat generated from the combustion device and to emit infrared radiation in a direction away from the combustion chamber, the combustion device including:

a nozzle provided in a flow path of the air, and configured to inject the fuel;

a tubular body including a side surface, wherein the tubular body protrudes from the bottom of the combustion chamber and in a direction that is perpendicular to the radiator, wherein the tubular body is spaced from the radiator, wherein a plurality of voids are formed in the side surface, wherein the air-fuel mixture flows into the tubular body from a first end of the tubular body in the nozzle side, wherein the tubular body releases the air-fuel mixture from the voids into the combustion space, and wherein the combustion space is surrounded by the radiator, the bottom, and the tubular body; and an ignition device provided outside of the tubular body and configured to ignite the air-fuel mixture.

2. The infrared radiation heater according to claim 1, wherein the voids are formed on the side surface of the tubular body in a circumferential direction.

3. The infrared radiation heater according to claim 2, wherein the voids are formed in a mesh pattern.

4. The infrared radiation heater according to claim 1, wherein:

the combustion device includes a heat insulator provided at a second end of the tubular body, and configured to insulate between the tubular body and the radiator; and the radiator is located to face the heat insulator.

5. The infrared radiation heater according to claim 1, wherein the combustion device is provided with an impeller in the flow path of the air to generate a swirl flow in the air-fuel mixture flowing through the tubular body.

6. The infrared radiation heater according to claim 5, wherein the impeller is a fixed type impeller made of a plate material.

* * * * *